US007395853B2

(12) United States Patent
Kroetsch et al.

(10) Patent No.: US 7,395,853 B2
(45) Date of Patent: Jul. 8, 2008

(54) HEAT EXCHANGER ASSEMBLY FOR A MOTOR VEHICLE

(75) Inventors: Karl Paul Kroetsch, Williamsville, NY (US); Steve C. Brick, Lockport, NY (US); Christopher Alfred Fuller, Buffalo, NY (US); David Matthew Smith, Niagara Falls, NY (US); Joel Thomas Hambruch, Burt, NY (US)

(73) Assignee: Delphi Technologies, Inc., Troy, MI (US)

( * ) Notice: Subject to any disclaimer, the term of this patent is extended or adjusted under 35 U.S.C. 154(b) by 685 days.

(21) Appl. No.: 10/956,889

(22) Filed: Oct. 1, 2004

(65) Prior Publication Data

US 2006/0070725 A1 Apr. 6, 2006

(51) Int. Cl.
*F28D 1/00* (2006.01)

(52) U.S. Cl. ..... 165/149; 165/67; 165/140; 165/144; 180/68.4

(58) Field of Classification Search ..... 29/890.03, 29/890.07, 890.035; 165/149
See application file for complete search history.

(56) References Cited

U.S. PATENT DOCUMENTS

| | | | | |
|---|---|---|---|---|
| 4,406,132 | A * | 9/1983 | Bolton et al. | 62/77 |
| 4,465,124 | A * | 8/1984 | Jacquet et al. | 165/67 |
| 4,534,407 | A | 8/1985 | Lardner | 165/81 |
| 5,236,042 | A | 8/1993 | Kado | 165/149 |
| 5,289,873 | A | 3/1994 | Ryan | 165/149 |
| 5,542,176 | A * | 8/1996 | Serizawa et al. | 29/890.03 |
| 6,061,904 | A * | 5/2000 | Watanabe et al. | 29/890.046 |
| 6,179,050 | B1 | 1/2001 | Dey | 165/149 |
| 6,357,519 | B1 * | 3/2002 | Ozaki et al. | 165/140 |
| 6,529,377 | B1 * | 3/2003 | Nelson et al. | 361/699 |
| 6,705,387 | B2 * | 3/2004 | Kokubunji et al. | 165/67 |
| 7,143,815 | B2 * | 12/2006 | Lee et al. | 165/80.4 |
| 2002/0056541 | A1 * | 5/2002 | Kokubunji et al. | 165/67 |
| 2002/0144805 | A1 * | 10/2002 | Kim et al. | 165/149 |
| 2003/0159816 | A1 | 8/2003 | Kodumudi | 165/176 |
| 2005/0101047 | A1 * | 5/2005 | Freeman et al. | 438/48 |
| 2005/0230089 | A1 * | 10/2005 | Ozaki | 165/149 |

FOREIGN PATENT DOCUMENTS

| | | |
|---|---|---|
| DE | 10343634 A1 | 4/2005 |
| EP | 0882940 | 12/1998 |
| EP | 1030157 | 8/2000 |
| EP | 1500892 A | 1/2005 |
| EP | 1528347 A | 5/2005 |
| EP | 1553373 A | 7/2005 |
| FR | 2735855 A | 12/1996 |

(Continued)

OTHER PUBLICATIONS

EP 05 07 7196 European Search Report Dated Sep. 2, 2006.

*Primary Examiner*—Cheryl J. Tyler
*Assistant Examiner*—Joseph Corrigan
(74) *Attorney, Agent, or Firm*—Patrick M. Griffin

(57) ABSTRACT

A heat exchanger assembly includes a core having first and second header tanks covered by tank caps. A pair of core reinforcing members presenting terminal ends extend between the first and second header tanks. A least one tab and an opening for receiving the tab are used for connecting the core reinforcing members to the tank caps.

6 Claims, 5 Drawing Sheets

FOREIGN PATENT DOCUMENTS

| | | | | |
|---|---|---|---|---|
| JP | 01114697 | A | * | 5/1989 |
| JP | 02040495 | A | * | 2/1990 |
| JP | 05060485 | A | * | 3/1993 |
| JP | 09126685 | A | | 5/1997 |
| JP | 10122785 | A | * | 5/1998 |
| JP | 2000283691 | A | | 10/2000 |
| JP | 2002350086 | A | * | 12/2002 |
| JP | 2003139484 | A | | 5/2003 |
| WO | WO-0022366 | | * | 4/2000 |
| WO | 2005001370 | A | | 1/2005 |

* cited by examiner

HEAT EXCHANGER ASSEMBLY FOR A MOTOR VEHICLE

FIELD OF THE INVENTION

The subject invention relates to a heat exchanger assembly of the type having a tank at each end of a core with the tanks having open ends that are closed by caps.

DESCRIPTION OF THE PRIOR ART

Typically, a heat exchanger includes a core having opposite ends and sides defined by a plurality of fins and tubes extending between the opposite sides and between the opposite ends. A pair of header tanks are disposed at the opposite ends of the core and are in fluid communication with the tubes. The header tanks have open ends closed by end caps. A pair of reinforcement members are held to the header tanks for brazing by passing the terminal ends of the reinforcement members through the header tanks.

Various methods and designs have been used for holding reinforcement members to header tanks for brazing. Such methods and designs are disclosed in the U.S. Pat. No. 4,534,407 to Lardner; U.S. Pat. No. 5,236,042 to Kado; U.S. Pat. No. 5,289,873 to Ryan et al.; U.S. Pat. No. 6,179,050 to Dey et al.; U.S. Pat. No. 6,705,387 to Kokubunji et al.; the United States Patent Application No. 2003/0159816 to Kodumudi et al.; European Patent Specification No. EP0882940; and European Patent Application No. EP1030157.

There is a constant need in the area of an automotive industry for improvements in a heat exchanger designs to improve the connection between the header tank and the reinforcement member for holding each of the reinforcement members to the header tanks as the heat exchanger assembly is brazed.

BRIEF SUMMARY OF INVENTION

A heat exchanger assembly for a motor vehicle includes a core having opposite sides and opposite ends with a plurality of fins extending between the opposite sides and a plurality of tubes extending between the opposite ends. First and second tanks have open ends and are disposed at the opposite ends of the core for fluid communication with the tubes. A plurality of tank caps close all of the open ends of the first and second tanks. A pair of core reinforcing members extend between terminal ends and are disposed along the opposite sides of the core. A tab and an opening for receiving the tab connect each of the tank caps to an adjacent terminal end of the reinforcing members. The tab has a head and a neck more narrower in width than the head with the opening smaller than the head for retaining the tab in the opening for connecting the reinforcing members to the tank caps as the heat exchanger is brazed.

An advantage of the present invention is to provide a heat exchanger assembly having a connection for holding to and preventing detachment of each of the core reinforcing members to the first and second tanks as a separation forces are applied thereto.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
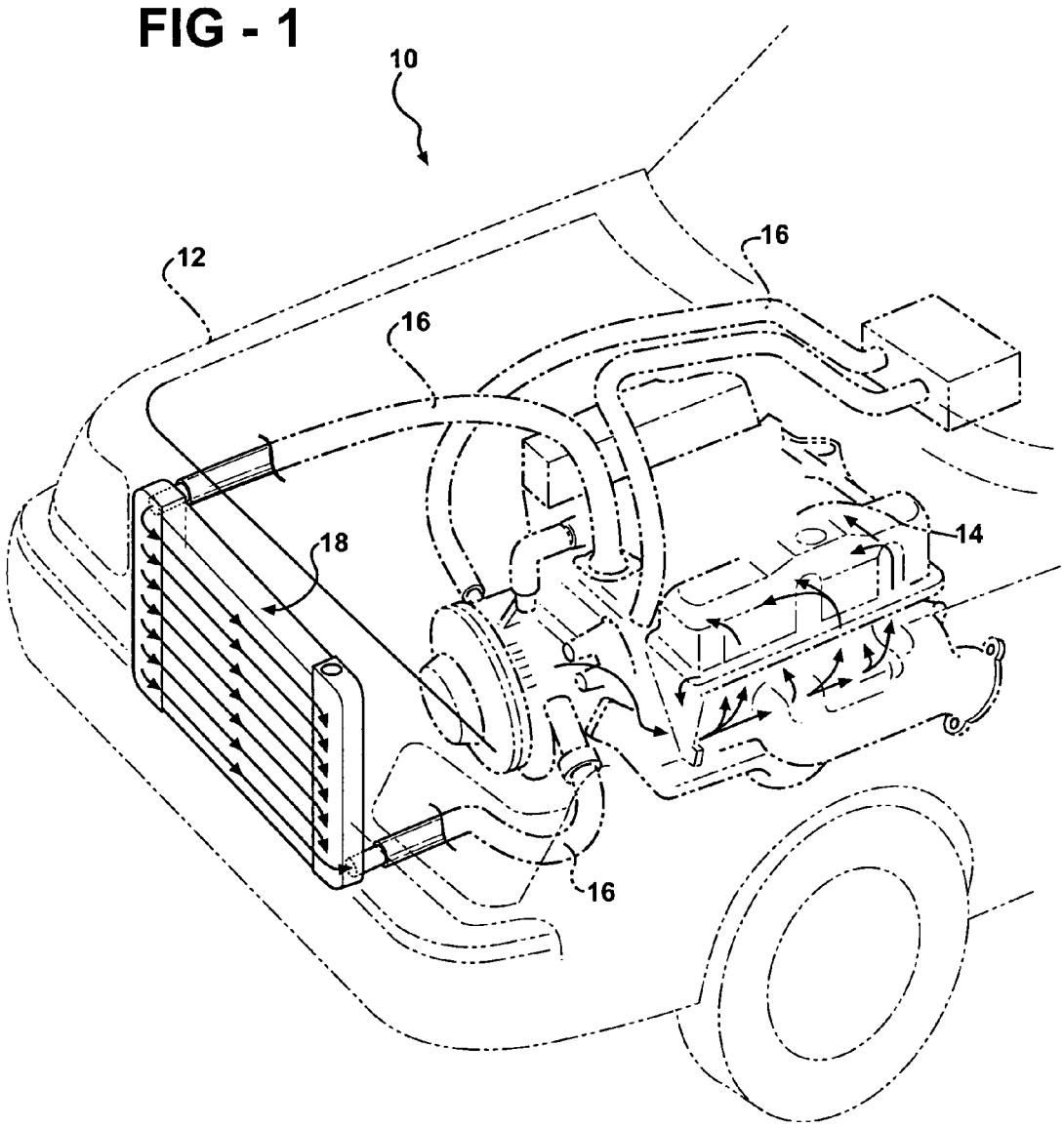
FIG. 1 is a perspective view of a cooling system for an automotive vehicle with the automotive vehicle shown in phantom.

Referring to FIG. 1, a cooling system, generally shown at 10 of a vehicle, generally shown in phantom at 12, circulates a fluid from an engine 14 through a hose 16 to a heat exchanger assembly or radiator, generally indicated at 18.

Figure 2:
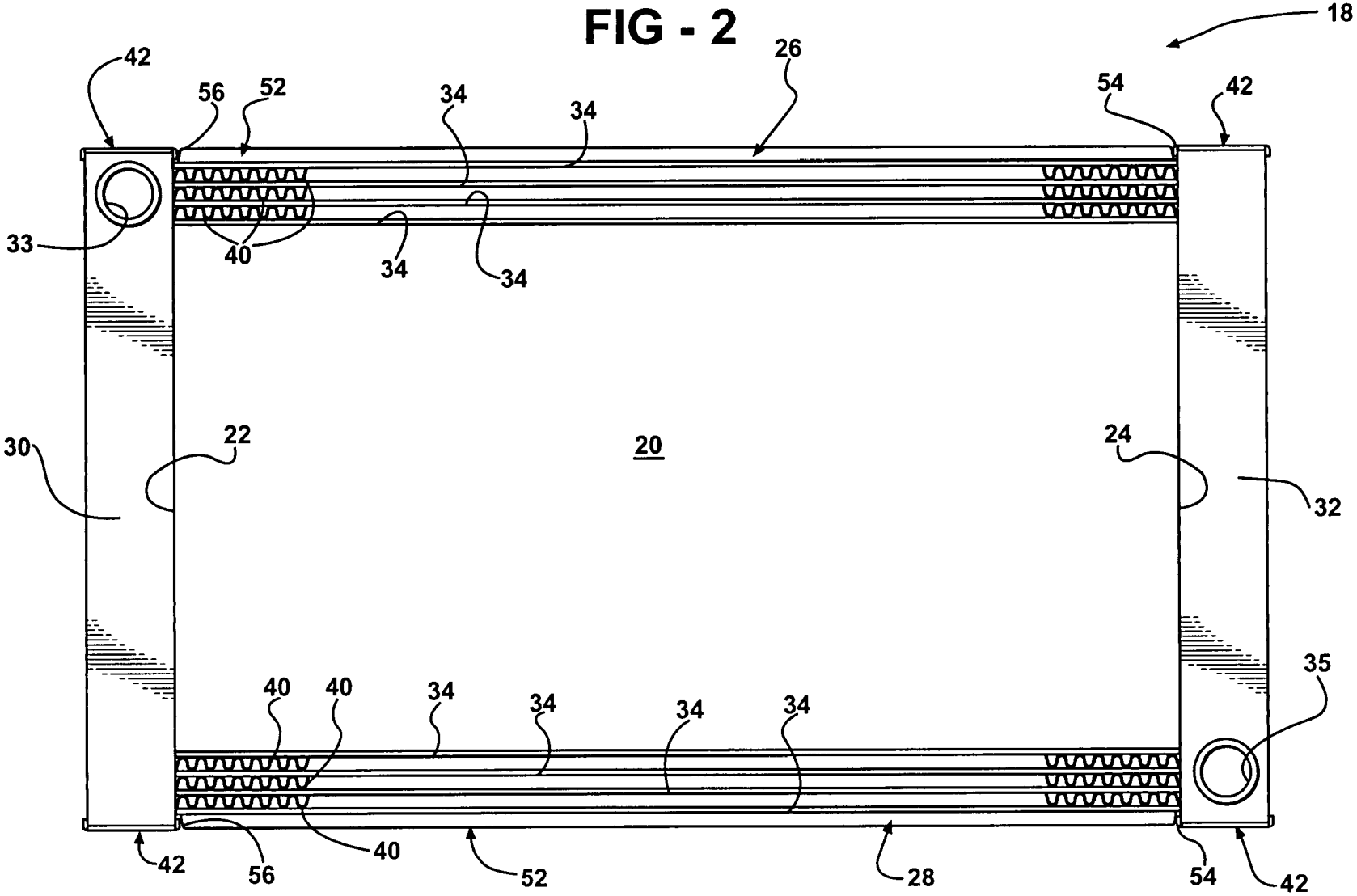
FIG. 2 is a front view of an heat exchanger assembly constructed in accordance with the subject invention.

As shown in FIG. 2, the heat exchanger assembly 18 of the present invention includes a core 20 having first and second opposite ends 22 and 24 and opposite sides 26 and 28 for cooling the fluid flowing internally. The core 20 is disposed or extends between a pair of first and second header tanks 30 and 32. The first header tank 30 is disposed at the first end 22 of the core 20 and the second tank 32 is disposed at the second end 24 of the core 20. A plurality of tubes 34, through which the fluid normally flows horizontally, are disposed to extend between the first 30 and second 32 tanks, as is well known in the art. The ends of the tubes 34 are inserted into openings or slots 36 defined in the respective first 30 and second 32 tanks for the fluid flow therebetween. The first 30 and second 32 tanks also include fluid connectors 33, 35, respectively, to act as an inlet and an outlet to convey the fluid into and out of the first 30 and second 32 tanks. The core 20 includes a plurality of corrugated fins 40 shown in FIG. 2. Each fin 40 is disposed between adjacent tubes 34 as is well known in the art. However, for simplicity, the fins 40 are not shown in the remaining Figures.

Figure 3:
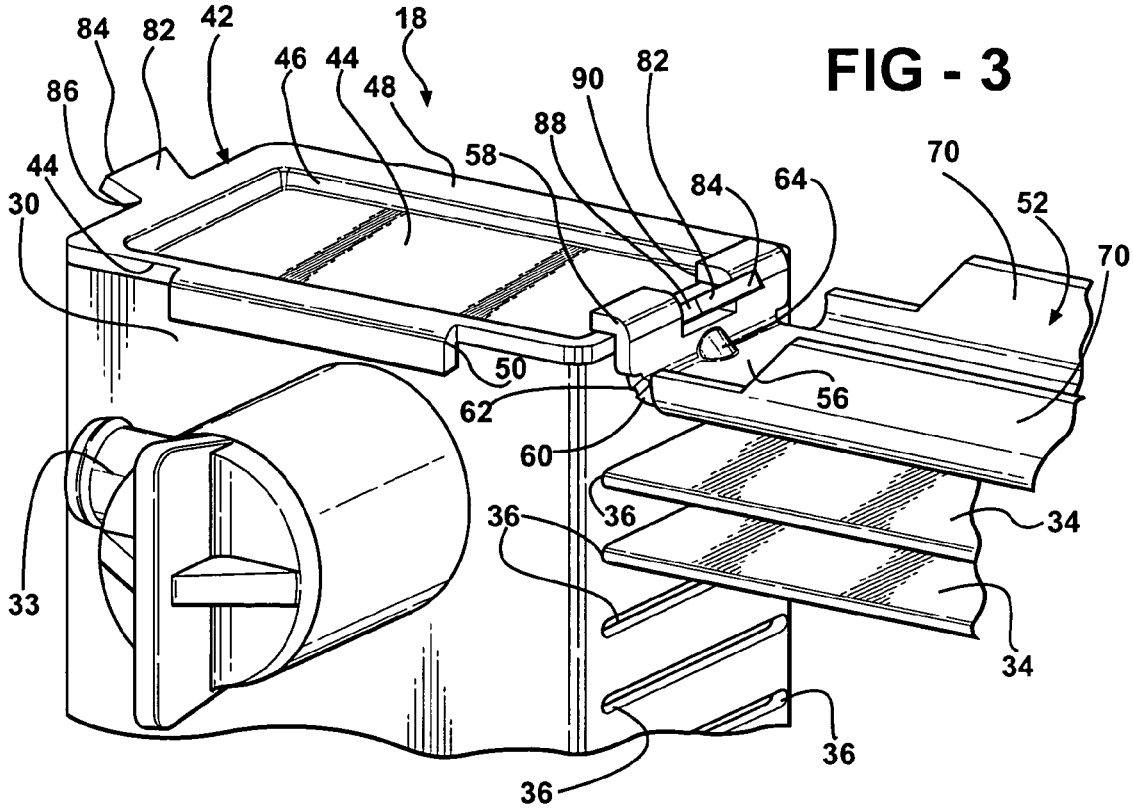
FIG. 3 is a fragmentary perspective view showing the upper left corner without fins of the heat exchanger assembly showing a header tank and a tank cap having a plurality of tabs extending from the tank caps but without showing the fins between the tubes.

The heat exchanger assembly 18 includes a plurality of tank caps, each generally indicated at 42. The tank caps 42 are configured for closing the opposite open ends of both of the first 30 and second 32 tanks at opposite terminal ends 22, 24 of the core 20. As illustrated in FIG. 3, each tank cap 42 is disposed in engagement with the open end of the first 30 and second 32 tanks. More specifically, in order to facilitate the closure of the open ends of the first 30 and second 32 tanks, each tank cap 42 has a recess or a dished configuration with a bottom 44 and sidewalls 46 below a rim 48 for disposition in the open end of the first 30 and second 32 tanks. The sidewalls 46 engage the interior of the open end of each tank 30 or 32 and the rim 48 engage the open end of each tank 30, 32 for being brazed thereto. A pair of rectangular flanges 50 are integral with and extend outwardly in the opposite directions to the rim 48 of each tank cap 42. The rectangular flanges 50 are clinched or bent over and downward into the exterior of each of the first 30 and second 32 tanks. The core 20, the tanks 30, 32, the fins 40, the tubes 34, and the tank caps 42 consist of one homogenous material, namely a metal such as aluminum.

As is customary in the art, a pair of a core reinforcing members, each generally shown at 52, extend along the opposite sides 26, 28 of the core 20. Each reinforcing member 52 presents terminal ends 54, 56 with each of the terminal ends 54, 56 presenting a pair of reversed interconnected first and second bends 58, 60 having an S-shaped configuration to engage the rim 48 of the adjacent tank cap 42. Each of the bends 58, 60 of the terminal ends 54, 56 are more narrow in width than the tank cap 42. A notch 62 is defined at each side of the terminal ends 54, 56 to define a bending joint between the second bend 60 at the intersection of the S-shaped configuration and the remainder of the reinforcing member 52. Each notch 62 assist to relieve stress applied to the core reinforcing member 52 thereby maintaining structural stability and braze clad surface contact as the heat exchanger assembly 18 is brazed. A gusset 64 is integral with and extends across the second bend 60 to provide structural support to each of the terminal ends 54, 56. Each of the core reinforcing members 52 includes a pair of spaced and parallel reinforcing flanges 70 extending upwardly and terminating short of the terminal ends 54, 56. The reinforcing flanges 70 extend upwardly along the sides of a flat bar. Each reinforcing member 52 consists of one homogenous material, namely a metal such as aluminum.

Figure 4:
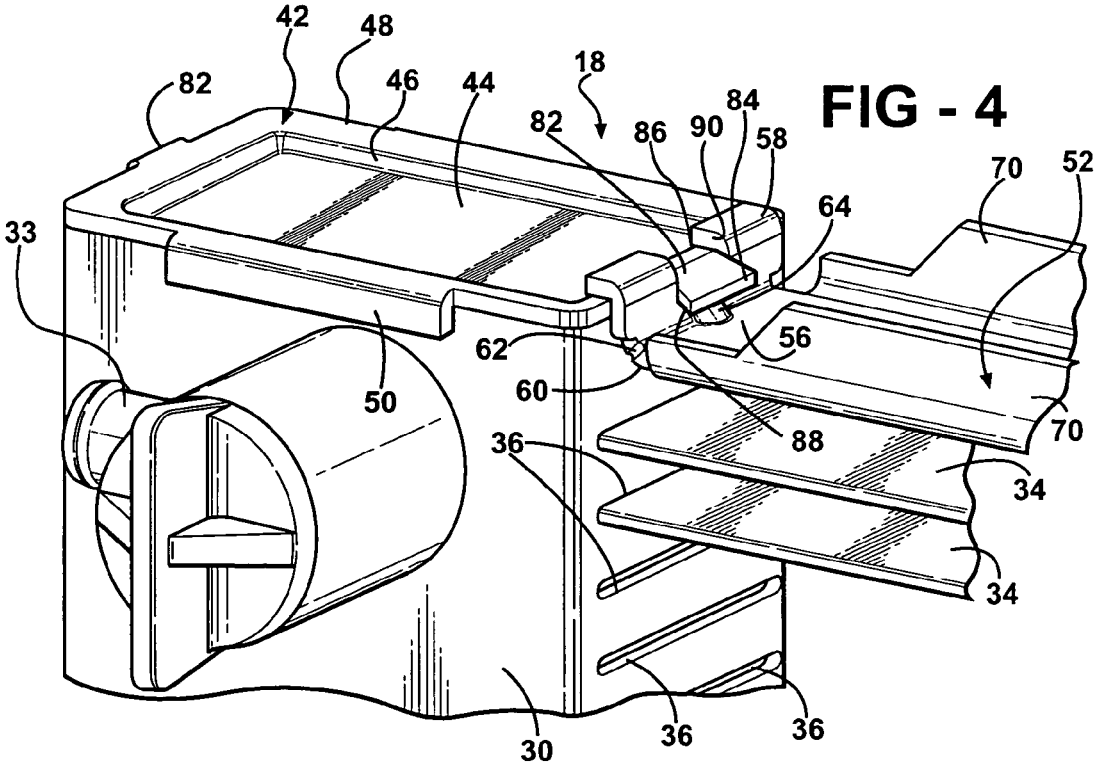
FIG. 4 is a fragmentary perspective view as shown in FIG. 3 showing the tabs in the bend and final connecting position.
Figure 5:
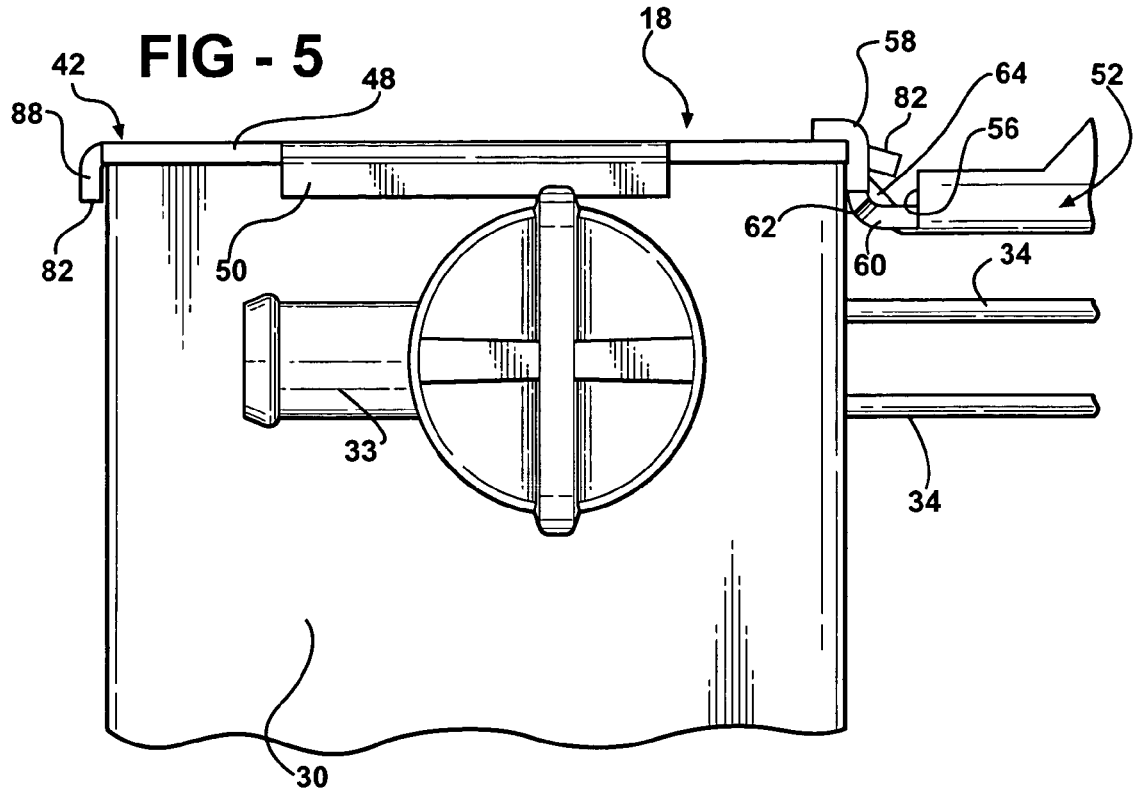
FIG. 5 is a fragmental side view of FIG. 4.

Referring to FIGS. 4 and 5, the a mechanical connection for connecting each of the tank caps 42 to the adjacent terminal ends 54, 56 of the reinforcing members 52 has tabs 82 integral with and sloping outwardly and bent downwardly into an opening or cut-out portion 90 defined in each terminal end 54, 56 of the core reinforcing member 52. Each tab 82 has a head 84 and a neck 86 more narrow in width than the head 84. The neck 86 and the head 84 are interconnected by outwardly tapered sides 88 to define a dovetailed configuration of the tab 82. The cut-out portion 90 presents a rectangular configuration having a width complementary to the width of the neck 86 to receive the tab 82. The cut-out portion 90 is just wide enough to receive the neck 86 but is smaller than the head 84 to retain the tab 82 in the cut-out portion 90 for connecting or holding the core reinforcing members 52 to the tank caps 42 as the heat exchanger assembly 18 is brazed.

Figure 6:
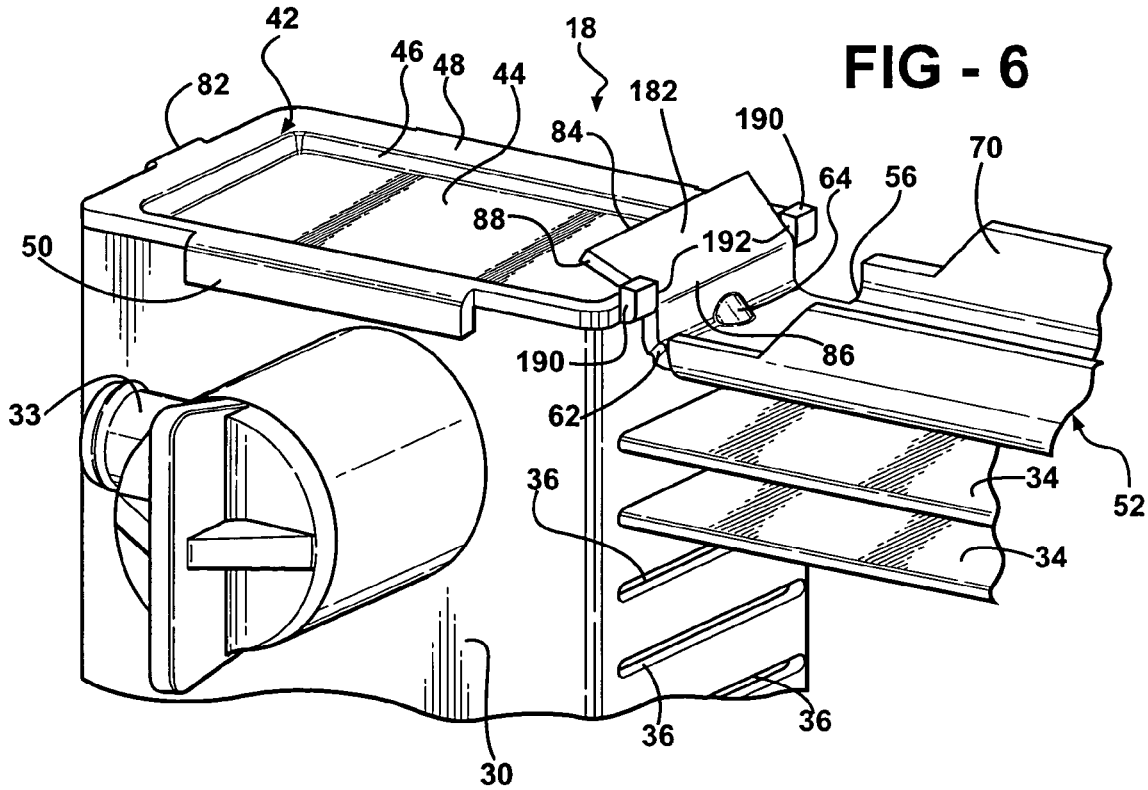
FIG. 6 a fragmentary perspective view of an alternative embodiment of the present invention showing the tabs extending from the core reinforcement members.
Figure 7:
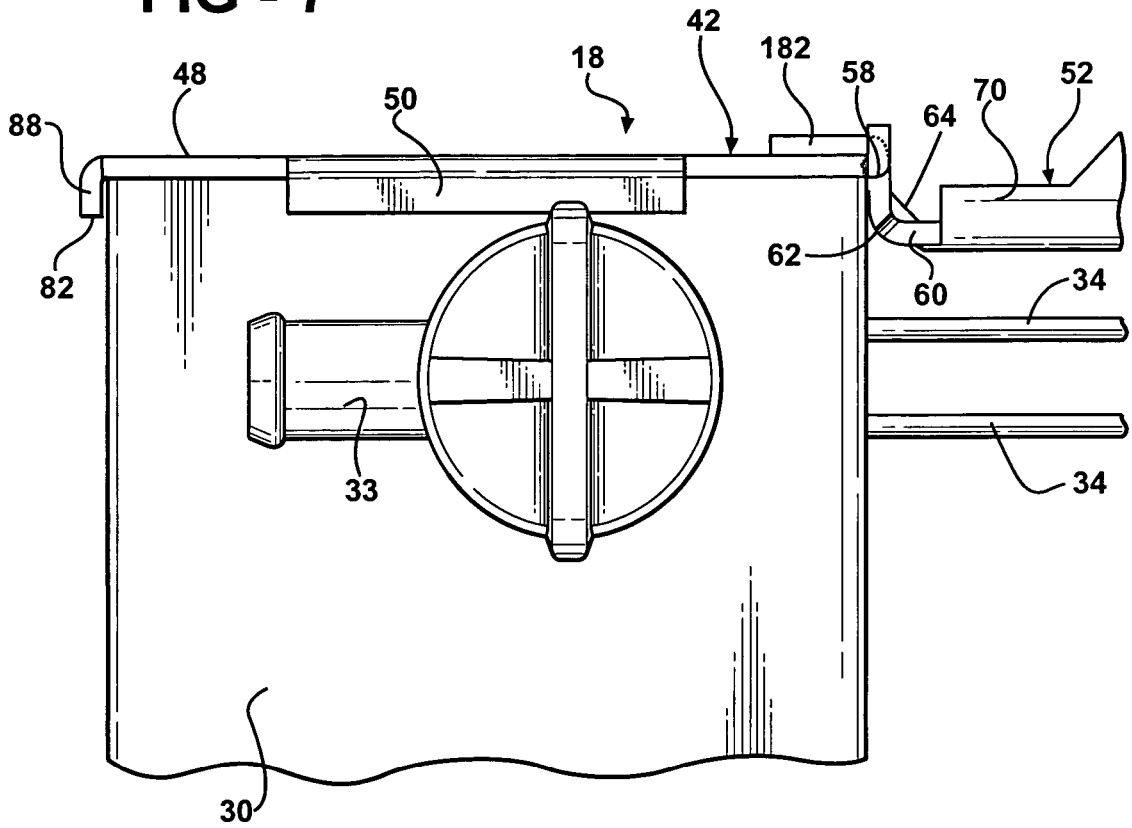
FIG. 7 is a fragmental side view of FIG. 6.

As shown in FIGS. 6 and 7, the heat exchanger assembly 18 of the present invention may include an alternative embodiment that reverses the components by placing a pair of spaced tabs 190 to define a cut-out portion 192 in the tank cap 42 and a dove-tailed tab 182 extending from the terminal ends 54, 56. While only one tab 82, 182 and one complementary cut-out portion 90, 192 have been disclosed in the present invention, the number of tabs 82, 182 and complementary cut-out portions 90, 190 connecting the terminal ends 54, 56 of each reinforcing member 52 to the tank cap 42 may be more than one. In addition, the tab and/or cut-out portions may be at one or both ends of each tank cap 42.

As appreciated by those skilled in the art, the aforementioned aluminum braze or brazing involves joining of components, such as, for example, the core 20 and the tanks 30, 32 prefabricated by having a brazing alloy (cladding) layer, i.e. outer layer (not shown) whose melting point is appreciably lower than that of the parent material (base alloy) base material, i.e. aluminum of the core 20 and the tanks 30, 32. The cladding, rolled onto the aluminum, is oriented adjacent to or in between the components to be joined, like, for example, the tank cap 42 and the tanks 30 or 32, whereby the heat exchanger assembly 18 is heated to a temperature where the cladding material melts and the parent material, i.e. aluminum does not. Upon cooling, the cladding forms a metallurgical bond between the joining surfaces of the components, i.e. the core 20, the first 30 and second 32 header tanks, the core reinforcing members 52, and the caps 42. The brazing process occurs in a furnace (not shown) as is well known in the art.

In automotive applications, the cladding is supplied via a thin layer on the base alloy. The base alloy provides the structural integrity while the low melting point cladding melts to form the brazed joints. The core 20, the first 30 and second 32 tanks, the core reinforcing members 52, and the tank caps 42, are formed from aluminum, aluminum alloy, and the like, and are integrally brazed in the furnace to provide the heat exchanger assembly 18 having high corrosion resistance and high heat conductivity characteristics.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat exchanger assembly for a motor vehicle comprising;

a core having opposite ends and opposite sides with a plurality of fins extending between said opposite sides and a plurality of tubes extending between said opposite ends, first and second tanks having open ends and disposed at said opposite ends of said core and in a fluid communication with said tubes, a plurality of tank caps with each tank cap closing one of said open ends to close all of said open ends, a pair of core reinforcing members each extending between terminal ends and disposed along said opposite sides of said core, a pair of rectangular flanges being integral with and extending outwardly in the opposite direction from said rim of said tank can and extending downwardly to engage the exterior of each tank, and at least one tab and an opening for receiving said tab for connecting each of said tank caps to an adjacent terminal end of said reinforcing members, wherein said tab has a head and a neck more narrow in width than said head with said opening smaller than said head for retaining said tab in said opening for connecting said core reinforcing members to said tank caps as said heat exchanger assembly is brazed, wherein each tank cap presents a recess having a bottom and sidewalls extending therefrom with said sidewalls engaging the interior of each tank and a rim surrounding said recess and engaging said open ends of each tank, wherein said at least one tab is integral with and extends outwardly from said rim of said tank cap with said at least one tab sloping to said core reinforcing member, wherein each of said terminal ends presents a S-shaped configuration having a pair of reversed bends having a S-shaped configuration with the first bend overlying said rim, wherein said reverse bends are more narrow in width than said tank cap, and wherein said second reverse bend includes a pair of opposite notches defined therein to present a bending joint between said second bend at the intersection of said S-shape and the remainder of said core reinforcing member.

2. A heat exchanger assembly as set forth in claim 1 including a gusset extending across said second bend to provide structural support to each of said S-shaped configuration at said terminal ends.

3. A heat exchanger assembly as set forth in claim 2 wherein each of said core reinforcing members includes a pair of spaced and parallel reinforcing flanges.

4. A heat exchanger assembly as set forth in claim 3 wherein said reinforcing flanges extend upwardly from said core reinforcing member and terminate short of said terminal ends.

5. A heat exchanger assembly as set forth in claim 4 wherein said core, said first and second tanks, said core reinforcing member, said tank caps, said tubes, and said fins are formed from aluminum.

6. A heat exchanger assembly as set forth in claim 5 wherein said care, said first and second tanks, said core reinforcing member, said tank caps, said tubes, and said fins are brazed together.

* * * * *